US007637578B2

(12) United States Patent
Chang et al.

(10) Patent No.: US 7,637,578 B2
(45) Date of Patent: Dec. 29, 2009

(54) PRINTING DATA PROCESSING APPARATUS AND METHOD THEREFOR

(75) Inventors: Chia-Ming Chang, Hsinchu (TW); Chao-Kai Cheng, Hsinchu (TW); Chih-Jian Lin, Hsinchu (TW); Chih-Hsuan Chiu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 484 days.

(21) Appl. No.: 11/716,650

(22) Filed: Mar. 12, 2007

(65) Prior Publication Data

US 2008/0110355 A1 May 15, 2008

(30) Foreign Application Priority Data

Nov. 10, 2006 (TW) ..... 95141793 A

(51) Int. Cl.
*B41J 29/38* (2006.01)

(52) U.S. Cl. ..... 347/5; 347/40; 347/41

(58) Field of Classification Search ..... 347/5, 347/9, 12, 20, 40–42, 49
See application file for complete search history.

(56) References Cited

U.S. PATENT DOCUMENTS 5,681,757 A 10/1997 Hayes
6,953,235 B2 10/2005 Silverbrook
7,458,658 B2 * 12/2008 Chang et al. ..... 347/41

FOREIGN PATENT DOCUMENTS

| | | | |
|---|---|---|---|
| JP | 4-115955 | A | 4/1992 |
| JP | 11-277734 | A | 10/1999 |
| WO | WO-02/098573 | A1 | 12/2002 |
| WO | WO-02/099848 | A2 | 12/2002 |
| WO | WO-2004/050260 | A2 | 6/2004 |

* cited by examiner

*Primary Examiner*—Juanita D Stephens
(74) *Attorney, Agent, or Firm*—Birch, Stewart, Kolasch & Birch, LLP

(57) ABSTRACT

A printing data processing apparatus for performing printing operations on an object to be printed is provided, which includes a plurality of printhead modules arranged in parallel, wherein each of the printhead modules has equal number of parallel printheads, each of the printheads has at least one jet orifice, and the simultaneously driven jet orifices on the parallel printheads of each of the printhead modules are arranged in a straight line with the jet orifices on the parallel printheads of the adjacent printhead module; a data processing unit for dividing a pattern format to be printed into a plurality of printing data and outputting a printing data signal; and a drive unit for receiving the printing data signal output by the data processing unit, and outputting a drive signal to the printhead modules, so that the printhead modules performs the printing operations synchronically and rotatably.

12 Claims, 3 Drawing Sheets

PRINTING DATA PROCESSING APPARATUS AND METHOD THEREFOR

CROSS-REFERENCE TO RELATED APPLICATIONS

This non-provisional application claims priority under 35 U.S.C. § 119(a) on Patent Application No(s). 095141793 filed in Taiwan, R.O.C. on Nov. 10, 2006, the entire contents of which are hereby incorporated by reference.

BACKGROUND OF THE INVENTION

1. Field of Invention

The present invention relates to a printing data processing apparatus and a method therefor, and more particularly to a printing data processing apparatus having rotatable printhead modules with adjustable spaces between modules and between printheads in the modules and a method therefor.

2. Related Art

Most of present image processing apparatuses, such as scanners, printers, fax machines, and multi-function peripherals, have the output function, such as printing and copying. In industrial application, a graphic printing system has been widely applied in, for example, manufacturing of printed circuit boards, ink jet printing of texts, and displays. Improving printing performance and shortening printing time have become important topics in respect of printing systems.

Patent Cooperation Treaty (PCT) Publication No. WO/2002/099848 discloses a system module for printing microcoated pattern, wherein printing operation is mainly controlled by adjusting output waveforms and the size and amount of jetted droplets. Further, PCT Publication No. WO/2004/050260 discloses a microcoating pattern system for jet printing a specific pattern on a substrate, wherein a mask that produces a printable specific pattern is mainly used, and during a jet printing process, the data to be jet printed each time should be calculated according to the mask, so as to overcome the defects of non-uniform density distribution caused by abnormal operation of ink jet orifices. Moreover, PCT Publication No. WO/2002/098573 discloses a printing structure of controlling ink jet waveforms, wherein a control unit is used to generate an jet printing waveform command, and the command is transmitted to jet orifices on printheads, so as to adjust the ink jet waveforms thereby producing a desired printed pattern, and meanwhile, the resolution of a printed file is adjusted by a printing method of rotating printheads. In addition, U.S. Pat. No. 5,681,757 discloses a printhead having a three-dimensional jet orifice array and an array printhead, wherein the printing operation is mainly performed by using jet orifices that may be individually controlled or the array printhead, so as to precisely control the size of droplets and printing positions thereof.

The aforementioned printing architectures having multiple printheads and methods therefor all divide printheads into a plurality of printhead modules to realize management, so as to accelerate the printing operation. However, if each printhead is respectively driven by a different drive signal, the complexity of the drive circuit of the printing system is increased, and the data management between the printhead modules cannot be accurately controlled, resulting in inconsistent printing operations, defects in printing quality, and especially mura phenomena occurring on junctures of the printhead modules. Furthermore, the inconsistent printing operations of the printhead modules also cause unnecessary platform operations, resulting in a prolonged printing time.

Therefore, it has become a problem to be solved eagerly how to provide an efficient data processing method under a platform architecture having multiple printhead modules, such that when the multiple printhead modules print the same pattern, not only the data to be printed may be successfully allocated to the corresponding printhead without generating defects due to the printing of different printheads, but also the printing operations of the printhead modules have consistency, thereby reducing the printing time.

SUMMARY OF THE INVENTION

In view of the aforementioned problems, the present invention is mainly directed to providing a printing data processing apparatus for performing a printing operation on an object to be printed. The printing data processing apparatus comprises a plurality of printhead modules arranged in parallel, wherein each of the printhead modules has equal number of parallel printheads, each of the printheads has at least one jet orifice, and the jet orifices on the parallel printheads of each of the printhead modules are arranged in a straight line with the jet orifices on the parallel printheads of the adjacent printhead module; a data processing unit for dividing a pattern format to be printed into a plurality of printing data and outputting a printing data signal; and a drive unit connected to the data processing unit for receiving the printing data signal output by the data processing unit, and outputting a drive signal to the printhead modules to perform the jet printing operations on the data to be printed; wherein the printhead modules perform the printing operations synchronically and rotatably, and the rotation angles of individual printhead modules are the same.

According to the aforementioned object, the present invention provides a printing data processing method applicable to a printing data processing apparatus to perform printing operations on an object to be printed. The printing data processing apparatus comprises a plurality of printhead modules arranged in parallel and rotating synchronically, wherein each of the printhead modules has equal number of parallel printheads, each of the printheads has at least one jet orifice, and the jet orifices on the parallel printheads of each of the printhead modules are arranged in a straight line with the jet orifices on the parallel printheads of the adjacent printhead module. The printing data processing method comprises setting a plurality of printing parameters comprising printhead rotation angle parameter, printing resolution parameter, jet orifice delay counter parameter, interlace number parameter, parallel printhead space parameter, and printhead module space parameter; dividing the object to be printed into a plurality of printing blocks according to the printhead module space parameter, each of the printhead modules corresponding to a printing block; dividing each of the printing blocks into a plurality of printing rows according to the printing resolution parameter; and allocating the data to be printed on the object to be printed to the jet orifices corresponding to the printhead modules according to the jet orifice delay counter parameter and the interlace number parameter.

In the present invention, all the parallel printheads share a drive signal through the printhead modules with adjustable spaces, so as to perform corresponding printing data process on the object to be printed, and the operations of the printheads are consistent, thereby avoiding the increase of the printing time due to redundant printing operations. Meanwhile, the data processing unit calculates the data on the junctures of the printing intervals of the printhead modules, thereby ensuring the correctness of the printing data on the junctures of the modules and achieving rapid and correct printing operations.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
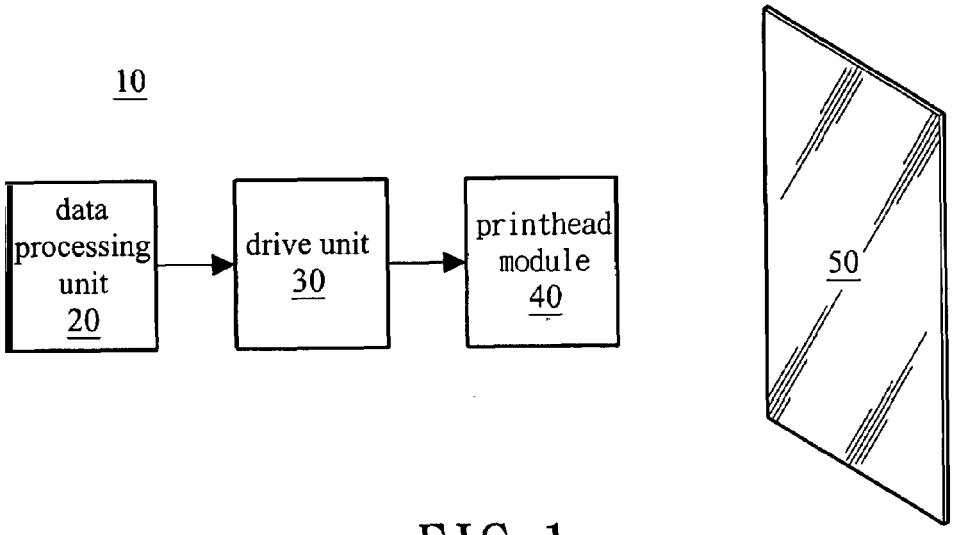
FIG. 1 is a block diagram of the functions of the printing data processing apparatus according to the present invention.

Referring to FIG. 1, a block diagram of the function of the printing data processing apparatus 10 according to the present invention is shown. As shown in FIG. 1, the printing data processing apparatus 10 of the present invention is used to perform printing operations on an object 50 to be printed. The printing data processing apparatus 10 includes a data processing unit 20, a drive unit 30, and a plurality of printhead modules 40. The data processing unit 20 is used to divide a pattern format to be printed on the object 50 to be printed into a plurality of printing data and then output a printing data signal. The drive unit 30 is electrically connected to the data processing unit 20, so as to receive the printing data signal output by the printing data processing unit 20, and output a drive signal to each of the printhead modules 40 synchronically, thus performing jet printing operations of the printing data. Furthermore, the printing data processing apparatus 10 further includes a data storage unit (not shown) for storing the printing data processed by the data processing unit 20, such that when a user need to repeatedly print the object 50 to be printed, the data to be printed on the object 50 to be printed may be directed retrieved from the data storage unit, so as to perform the printing operations. Additionally, the format of the pattern to be printed on the object 50 to be printed is a Gerber file.

Figure 2:
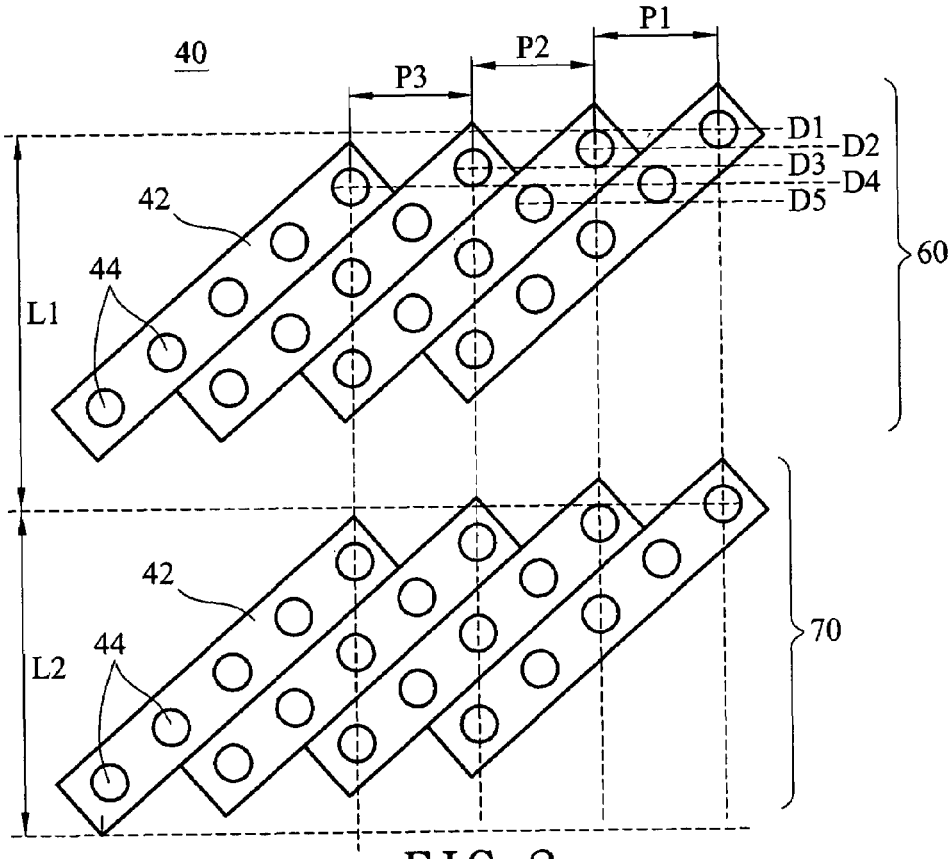
FIG. 2 is a schematic view of the printhead module of the printing data processing apparatus according to the present invention.

Referring to FIG. 2, a schematic view of the printhead module of the printing data processing apparatus according to the present invention is shown. As shown in FIG. 2, the printing data processing apparatus 10 of the present invention includes a plurality of printhead modules 40. It should be noted that, for sake of convenient illustration, the figure of this embodiment only shows two printhead modules 60 and 70, and of course, the number of the printhead modules 40 of the present invention is not limited to two, and can be adjusted depending upon the user's requirements and the design of the printer.

The printhead modules 60 and 70 are arranged in parallel, and an adjustable vertical predetermined space L1, L2 is respectively provided between each of the printhead modules 60 and 70, wherein the vertical predetermined spaces L1 and L2 are different. Each of the printhead modules 60 and 70 has a plurality of parallel printheads 42 with equal number, and each of the parallel printheads 42 has at least one jet orifice 44. In this embodiment, the printhead modules 60 and 70 both have four parallel printheads 42, each of the parallel printheads 42 has five jet orifices 44, and an adjustable horizontal predetermined spaces P1, P2, and P3 is respectively provided between each of the parallel printheads 42, wherein the horizontal predetermined spaces P1, P2, and P3 are different. Furthermore, the jet orifices 44 on the corresponding parallel printheads 42 of the printhead modules 60 and 70 are arranged in a straight line. For example, the first jet orifice 44 on the first parallel printhead 42 of the printhead module 60 is arranged in a straight line with the first jet orifice 44 on the first parallel printhead 42 of the printhead module 70.

When a user performs printing operations on the object 50 to be printed, the object 50 to be printed moves in the direction of the arrow in FIG. 1, the pattern format to be printed on the object 50 to be printed is divided into the printing data that should be performed by each of the printhead modules 60 and 70 by the data processing unit 20 according to the vertical predetermined spaces L1 and L2, the horizontal predetermined spaces P1, P2, and P3 between the parallel printheads 42 of the printhead modules 60 and 70, and the rotation angles of each of the printheads 42. After that, the parallel printheads 42 of the printhead modules 60 and 70 are driven by the drive unit 30 to perform the printing operations on the object to be printed. Furthermore, the rotation angles of the printhead modules 60 and 70 fall in the range of 0 to 90 degrees.

Figure 3:
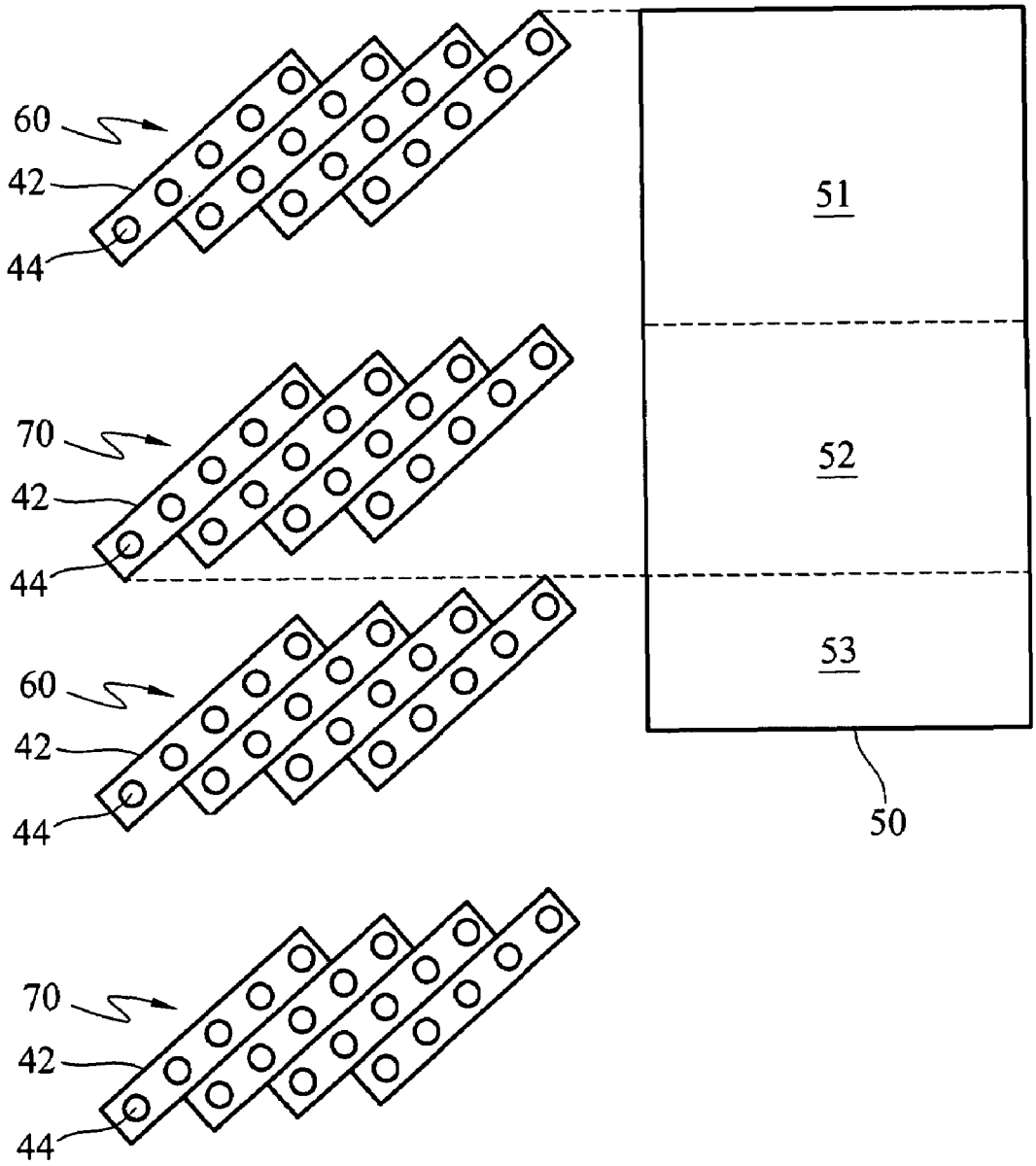
FIGS. 3 and 4 are schematic views of the printhead modules in the present invention performing printing operations on an object to be printed.

Referring to FIG. 3, a schematic view of the printhead modules of the present invention performing the printing operations on an object to be printed is shown. As shown in FIG. 3, the printing data processing method of the present invention includes the steps as follows. First, a plurality of printing parameters of each of the printhead modules 60 and 70 is set by the data processing unit 20 according to the size of the printing area of the object 50 to be printed, wherein the printing parameters include rotation angle parameter of the parallel printheads 42, delay counter parameter of the jet orifices 44, printing resolution parameter, interlace number parameter, parameter of the spaces P1 to P3 of the parallel printheads, and parameter of the spaces L1 to L2 of the printhead modules. Then, according to the parameter of the spaces L1 to L2 of the printhead modules, the data to be printed on the object 50 to be printed is divided into a plurality of printing blocks 51, 52, and 53. Subsequently, according to the printing resolution parameter, each of the printing blocks 51, 52, and 53 is divided into a plurality of printing rows. At this point, the number of the printing rows of each of the printing blocks 51, 52, and 53 equals to the result of diving the spaces L1 or L2 of the printhead modules by the printing resolution parameter.

When the length of the object 50 to be printed goes beyond the printable range of the printing data processing apparatus 10, i.e., the total length L1+L2 of the printhead modules 60 and 70 or the total length of the printing blocks 51 and 52, the data processing unit 20 should repeat the data extraction calculation of each of the printhead modules 60 and 70 until all of the printing data of the printing blocks 51, 52, and 53 is extracted. That is to say, as for the portion (i.e., the block 53) of the object 50 to be printed which goes beyond the total length L1+L2 of the printhead modules 60 and 70, the printing data allocation should be performed on the printhead modules 60 and 70 more than once.

Figure 4:
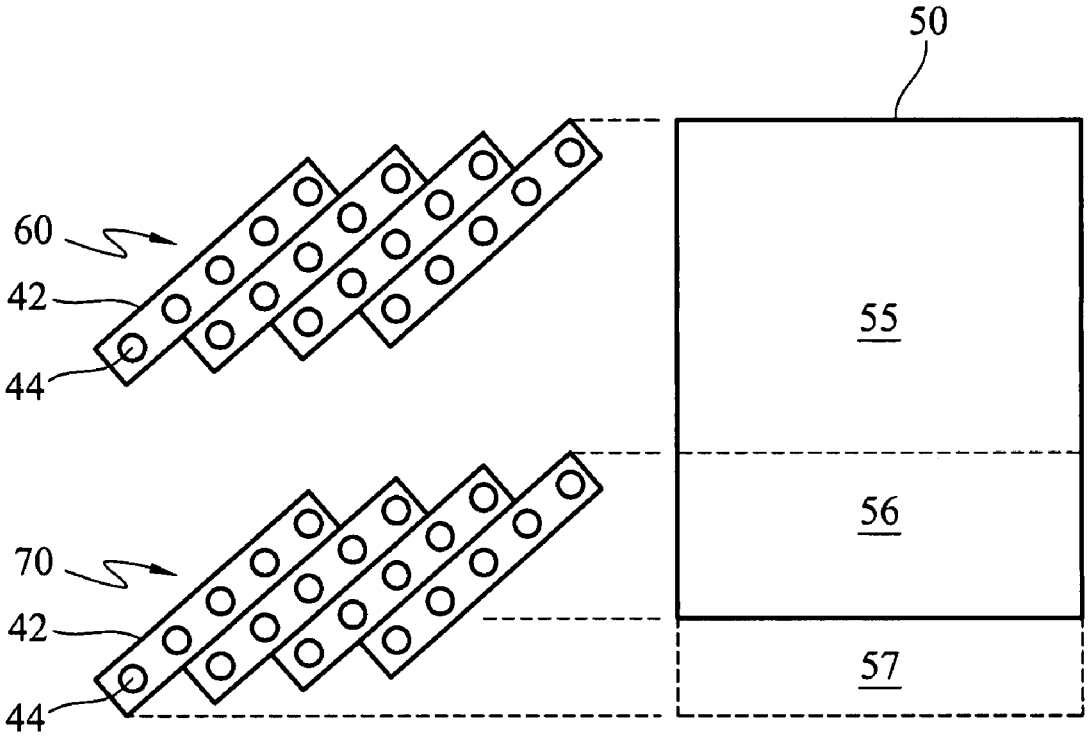

Furthermore, while the data processing unit 20 extracts data, each of the printhead modules 60 and 70 should be checked to determine whether the parallel printheads 42 are still in the printing interval. As shown in FIG. 4, the printing blocks 55 and 56 of the object 50 to be printed are in the printing interval of the printhead modules 60 and 70, and the printhead module 70 exceeds the object 50 to be printed by a virtual printing block 57. At this point, the data processing unit 20 performs Dummy or equivalent processes on the jet orifices 44 in the printhead module 70 exceeding the printing interval (i.e., the portion corresponding to the virtual printing block 57). That is to say, the parallel printheads 42 of the printhead module 60 corresponding to the printing block 55 are all located in the printing interval, and are still in the region where the printing data is calculated normally. The parallel printheads 42 of the printhead module 70 corresponding to the printing block 56 are all located in the printing interval, and are still in the region where the printing data is calculated normally. The parallel printheads 42 of the printhead module 70 corresponding to the virtual printing block 57 have exceeded the printing interval. Therefore, the printing block 55 establishes the printing data in each printing row according to a general data establishing method, the data in the printing block 56 should be determined by the data processing unit 20, and whether there is data exceeding the printing interval should be determined, wherein if there is no such data, the printing data in the printing row is established by a general data processing method, and otherwise, Dummy Row must be established for the jet orifices 44 of the printhead module 70 corresponding to the virtual printing block 57.

Finally, the data processing unit 20 allocates the data to be printed on the object 50 to be printed to the jet orifices 44 of each of the printhead modules 60 and 70 according to the jet orifice delay counter parameter and the interlace number parameter, so as to perform the printing operations on the object 50 to be printed. In this embodiment, the jet orifice delay counter parameter can be deduced from the horizontal predetermined spaces P1, P2, and P3 of the parallel printheads 42. Referring to FIG. 2 again, D1-D5 are the delay counters caused by the jet orifices 44, and the values of the delay counters are respectively D0=0; D1=P1; D2=P2; D4=D; and D5=P1+D. When the serial number of the jet orifices 44 is N and the serial number of the parallel printheads 42 is A, the jet orifice delay counter parameter is D(N, A)=PA+N*D, wherein the serial number of the printheads 42 refers to the serial number of the printheads 42 closest to the object 50 to be printed, and the parameter D is the delay counter caused by the rotation of the printheads.

Compared with the conventional art, the printing data processing apparatus and the method therefor provided by the present invention can be used to efficiently and correctly print the data blocks transmitted by scanners, printers, fax machines, multi-function peripherals, computers, or the like. All the parallel printheads share a drive signal through the printhead modules with adjustable spaces, so as to perform corresponding printing data process on the object to be printed, and the operations of the printheads are consistent, thereby avoiding the increase of the printing time due to redundant printing operations. Meanwhile, the data processing unit calculates the data on the junctures of the printing intervals of the printhead modules, thereby ensuring the correctness of the printing data on the junctures of the modules and achieving rapid and correct printing operations.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing data processing apparatus, for performing printing operations on an object to be printed, comprising:

a plurality of printhead modules arranged in parallel, wherein each of the printhead modules has equal number of parallel printheads, each of the printheads has at least one jet orifice, and the jet orifices on the parallel printheads of each of the printhead modules are arranged in a straight line with the jet orifices on the parallel printheads of the adjacent printhead module;

a data processing unit, for dividing a pattern format to be printed into a plurality of printing data and outputting a printing data signal; and a drive unit, connected to the data processing unit, for receiving the printing data signal output by the data processing unit and outputting a drive signal to the printhead modules, so as to perform a jet printing operation on the printing data;

wherein the printhead modules perform the jet printing operations synchronically and rotatably.

2. The printing data processing apparatus as claimed in claim 1, wherein rotation angles of the individual printhead modules are the same.

3. The printing data processing apparatus as claimed in claim 1, further comprising a data storage unit for storing the printing data.

4. The printing data processing apparatus as claimed in claim 1, wherein an adjustable vertical predetermined space is provided between each of the printhead modules, respectively, and the data processing unit allocates the corresponding printing data to each of the printhead modules according to the vertical predetermined space of each of the printhead modules.

5. The printing data processing apparatus as claimed in claim 4, wherein the vertical predetermined spaces are different from each other.

6. The printing data processing apparatus as claimed in claim 1, wherein an adjustable horizontal predetermined space is provided between the parallel printheads of each of the printhead modules, respectively.

7. The printing data processing apparatus as claimed in claim 6, wherein the horizontal predetermined spaces are different from each other.

8. The printing data processing apparatus as claimed in claim 1, wherein the rotation angles of the printhead modules fall in the range of 0 to 90 degrees.

9. The printing data processing apparatus as claimed in claim 1, wherein the pattern format to be printed is a Gerber file.

10. A printing data processing method, applicable to a printing data processing apparatus to perform printing operations on an object to be printed, wherein the printing data processing apparatus comprises a plurality of printhead modules arranged in parallel and rotating synchronically, each of the printhead modules has equal number of parallel printheads, each of the printheads has at least one jet orifice, and the jet orifices on the parallel printheads of each of the printhead modules are arranged in a straight line with the jet orifices on the parallel printheads of the adjacent printhead module, the printing data processing method comprising:

setting a plurality of printing parameters comprising printhead rotation angle parameter, printing resolution parameter, jet orifice delay counter parameter, interlace number parameter, parallel printhead space parameter, and printhead module space parameter;

dividing the object to be printed into a plurality of printing blocks according to the printhead module space parameter, each of the printhead modules corresponding to a printing block;

dividing each of the printing blocks into a plurality of printing rows according to the printing resolution parameter; and allocating the printing data of the object to be printed into the jet orifices corresponding to the printhead modules according to the jet orifice delay counter parameter and the interlace number parameter.

11. The printing data processing method as claimed in claim 10, wherein the printing parameters are set by a printing data processing unit.

12. The printing data processing method as claimed in claim 11, further comprising:

using the data processing unit to check whether the jet orifices of the printheads of each of the printhead modules are located in the printing intervals of the printing blocks, wherein if yes, the printing operations are performed; if no, the data process of Dummy is performed on the jet orifices of the printhead modules going beyond the printing blocks.

* * * * *